US005649761A

United States Patent [19]

Sandell et al.

[11] Patent Number: 5,649,761

[45] Date of Patent: Jul. 22, 1997

[54] MOTION DETECTOR WITH SIDE-PIVOTING LIGHT FIXTURE

[75] Inventors: Donald R. Sandell, San Jose; Wade Lee, Lafayette, both of Calif.

[73] Assignee: Larry C. Y. Lee, Hayward, Calif.

[21] Appl. No.: 532,096

[22] Filed: Aug. 11, 1995

[51] Int. Cl.[6] ..... F21S 1/14

[52] U.S. Cl. ..... 362/276; 362/394; 362/421; 362/802

[58] Field of Search ..... 362/147, 287, 362/394, 421, 427, 802, 250, 276, 391

[56] References Cited

U.S. PATENT DOCUMENTS

| | | | |
|---|---|---|---|
| D. 361,148 | 8/1995 | Wedell | D62/63 |
| 4,281,370 | 7/1981 | Masenheimer et al. | 362/287 |
| 5,086,379 | 2/1992 | Denison et al. | 362/391 |
| 5,258,899 | 11/1993 | Chen | 362/394 |
| 5,335,159 | 8/1994 | Chen et al. | 362/421 |
| 5,381,323 | 1/1995 | Osteen et al. | 362/276 |

OTHER PUBLICATIONS

"Introducing the New Generation of Motion Detector Lighting," Intelectron promotional literature, 1994.

*Primary Examiner*—Stephen F. Husar
*Assistant Examiner*—Alfred Basichas
*Attorney, Agent, or Firm*—Elliot B. Aronson

[57] ABSTRACT

A light fixture controlled by a passive infrared motion detector including a base, one or more lamp holders attached to the base, and a detector housing also attached to the base and containing the motion detector. The lamp holders each comprise a socket housing for receiving a floodlight bulb or the like and a shade or reflector at the front of the socket housing. The lamp holder assembly is connected to the base by a support arm that is pivotably connected to a side wall of the socket housing offset from the end of the socket housing instead of being connected at the end of the socket housing as is conventional. The pivoting side mounting of the lamp holder permits the lamp holder to pivot with a moment arm that is significantly shorter than the overall length of the lamp holder. The shortened moment arm permits the motion detector housing to be mounted closer to the supporting base while leaving sufficient space for the lamp holders to swing through a wide range of movement without the risk of inducing false activations through interference with the movable motion detector housing.

5 Claims, 3 Drawing Sheets

MOTION DETECTOR WITH SIDE-PIVOTING LIGHT FIXTURE

BACKGROUND OF THE INVENTION

The present invention relates generally to lighting fixtures activated by passive infrared motion detectors and is particularly directed to such lighting fixtures that include floodlights or spotlights that may be aimed in desired directions.

A passive infrared (PIR) motion detector is a device used to turn on a light when a person or motor vehicle enters a monitored area. Such devices are often used with outdoor residential lighting, for example, to illuminate an area as a person approaches or to illuminate a driveway as a car approaches. The PIR motion detector functions by sensing heat in the form of infrared radiation emanating from a person or similarly warm object as the person or object enters or moves about in the field of view of the detector. When the motion detector detects an appropriate heat impulse characteristic of a moving heat source, it provides an electrical signal to activate the light. The motion detector commonly keeps the light on for a pre-set duration after motion has been detected. Thus, for example, when a person enters the motion detector's field of view, a light comes on and remains on typically for five, ten or fifteen minutes at the selection of the user. The light is then automatically extinguished at the end of the pre-set period unless further motion is detected.

The typical motion-detector activated floodlight includes a supporting base that is mounted on a wall or that is soffit mounted, for example, on a side wall of a house, and one or two floodlight holder assemblies that are mounted on the base. The floodlight holder assemblies, which are sometimes referred to simply as lamp holders, are typically connected to the base by an arm that is pivotally connected to the back end of the lamp holder. The pivoting connection permits the lamp to be aimed in a desired direction. The motion detector is contained in a separate housing that is also connected to the base by a pivoting connection so that it too may be aimed in a desired direction.

A problem with false activations can arise, however, if the floodlights and the motion detector are aimed so that even a small portion of a lamp holder assembly falls within the field of view of the motion detector. In this case the heat from a lamp holder and lamp that has just been extinguished can trigger the motion detector to re-energize the lamp. It is common practice for the motion detector to include electronic circuitry that disables the motion detector for a very brief re-set period when the light is extinguished to permit the light to cool down before the motion detector is re-armed. When a portion of the floodlight housing protrudes into the field of view of the motion detector, however, the usual re-set period is not long enough. Increasing the duration of the re-set period to allow the lamp to cool sufficiently would lead to an unacceptably long time during which the motion detector would be disarmed. In the past motion-detector controlled floodlights have avoided this problem primarily by mounting the motion detector housing sufficiently far from the floodlights. This is typically achieved by mounting the detector housing on a support arm that juts out and/or down from the base far enough to avoid interference from the floodlights. The result is a lighting fixture that is unduly large with lanky arms (for the motion detector and the lamp holders) that dominate the overall appearance of the fixture and that limit the range of aesthetic designs for such a fixture.

SUMMARY OF THE INVENTION

The present invention provides a light fixture that overcomes the tradeoffs in floodlight fixtures of the past. The invention provides a simple, but elegant solution that avoids the false activation problem referred to above while permitting the light fixture to have a more compact overall arrangement than previously found possible and that opens up a whole new range of possibilities for the aesthetic design of such fixtures. Briefly, the advantages of the invention are accomplished by a new mounting for the lamp holder assemblies. A lamp holder assembly includes a socket housing for receiving a floodlight bulb or the like and a shade or reflector at the front of the socket housing. The lamp holder assembly is connected to a supporting base by a support arm that is pivotably connected to a side wall of the socket housing offset from the end of the socket housing instead of being connected at the end of the socket housing as is conventional. The pivoting side mounting of the lamp holder permits the lamp holder to pivot with a moment arm that is significantly shorter than the overall length of the lamp holder. The shortened moment arm permits the motion detector housing to be mounted closer to the supporting base while leaving sufficient space for the lamp holders to swing through a wide range of movement without the risk of inducing false activations. Other aspects, advantages, and novel features of the invention are described below or will be readily apparent to those skilled in the art from the following specifications and drawings of illustrative embodiments.

DETAILED DESCRIPTION OF ILLUSTRATIVE EMBODIMENTS

Figure 1:
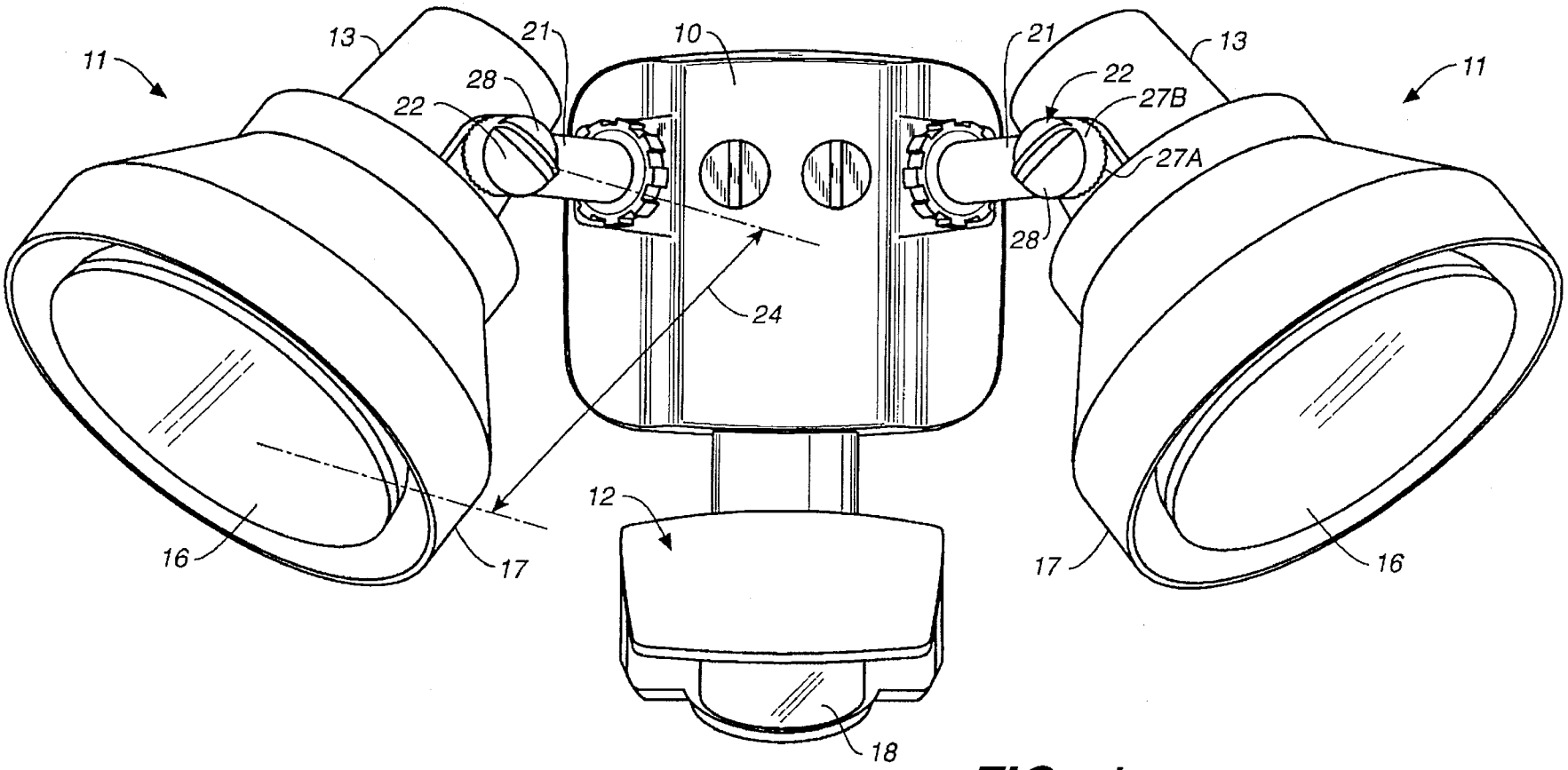
FIG. 1 is a front perspective view of a light fixture according to the invention.
Figure 2:
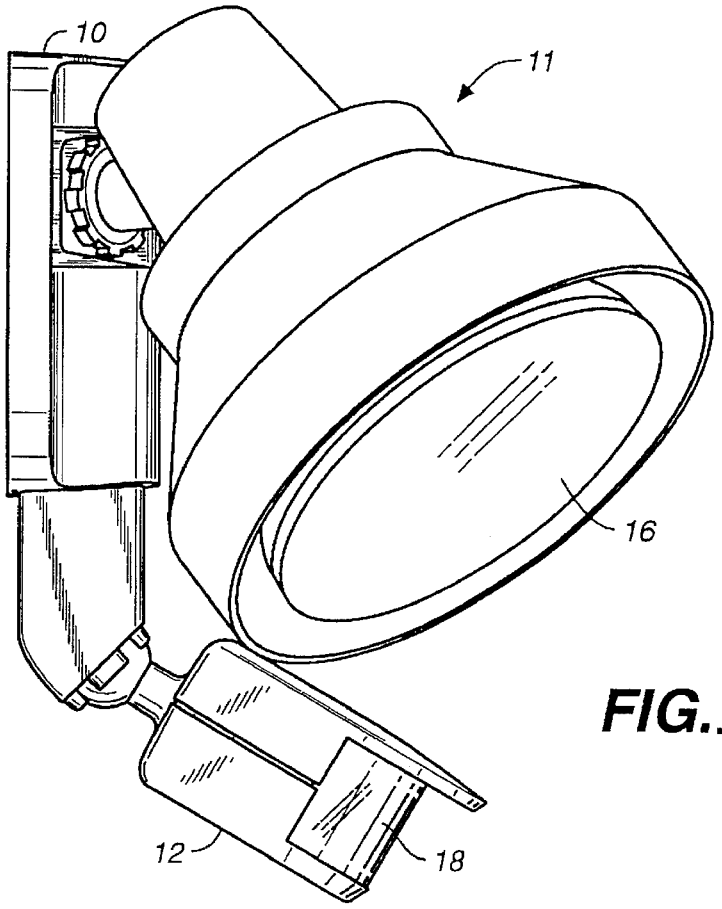
FIG. 2 is a side perspective view of a light fixture aimed at a close-in range.
Figure 2A:
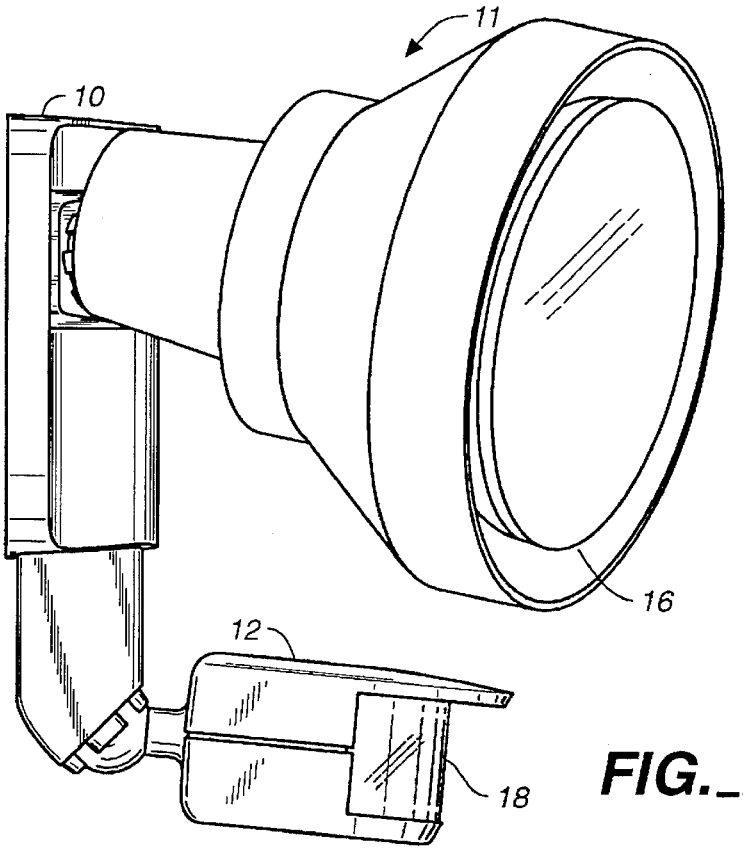
FIG. 2A is a side perspective view of a light fixture aimed at a far range.

FIG. 1 shows an overall view of a floodlight fixture according to the invention including a supporting base 10, a pair of lamp holders 11, and an infrared motion detector contained in a detector housing 12. Lamp holder 11 includes a socket housing 13 that houses an electrical lamp socket 14 for receiving a light bulb 16. FIGS. 1, 2 and 2A show a floodlamp bulb although other types of bulbs may of course also be used. Attached to the front of socket housing 13 is a shade or reflector 17 that surrounds the lamp bulb 16.

Motion detector housing 12 includes a sensor responsive to infrared radiation (not shown) and a lens member 18 including a plurality of lenslets (not shown) that define a plurality of zones that taken together define the motion detector's field of view. The structure and operation of suitable motion detector units is well known and thus need not be described in detail here. A typical field of view for use with a floodlight fixture such as that illustrated here will have a lateral spread in the range of 90 to 180 degrees or possibly more.

Figure 3:
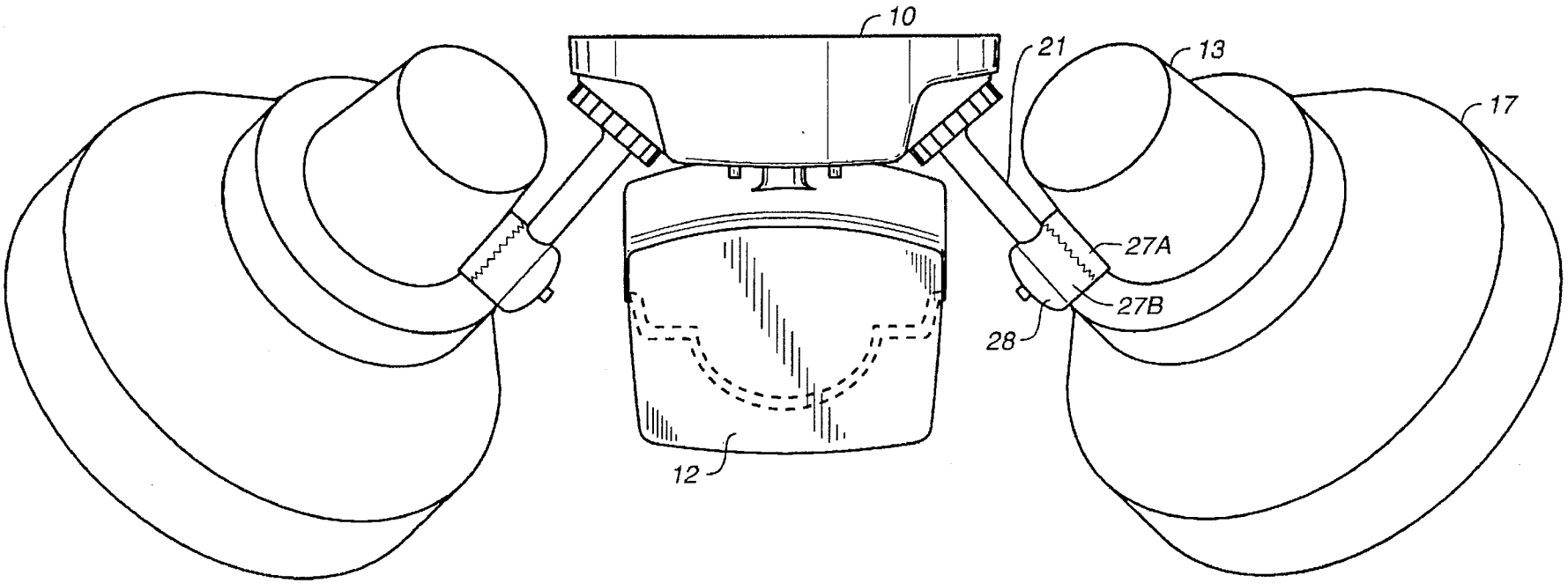
FIG. 3 is a top plan view of the light fixture of FIG. 1.
Figure 3A:
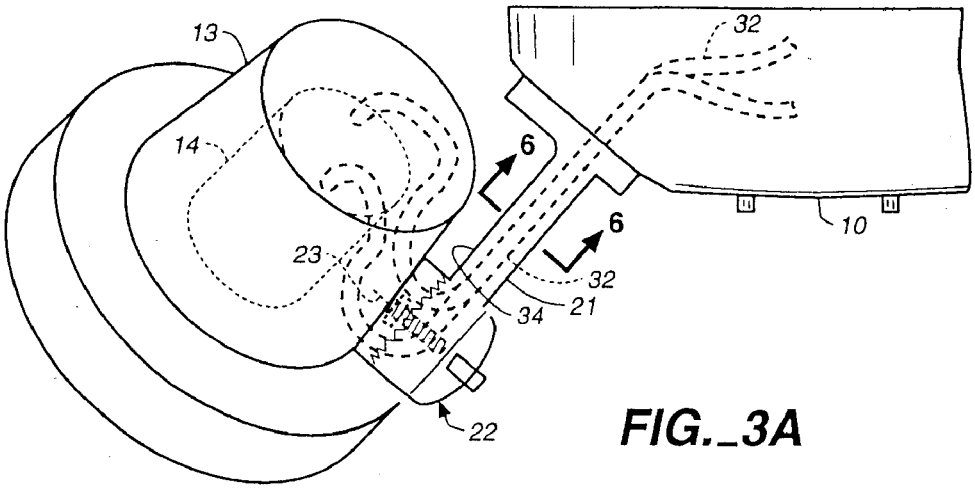
FIG. 3A is a diagrammatic plan view of a lamp holder assembly showing the electrical wiring.

Lamp holder 11 is connected to base 10 by support arm 21. In the embodiment of FIG. 1 support arm 21 is attached to base 10 in a conventional manner, for example, with a bayonet type mounting. The opposite end of support arm 21 is coupled to socket housing 13 through a pivoting or swivel connection 22. The connection to socket housing 13 is made at the side wall of the socket housing, unlike the prior art in which the connection is made at the far end of the socket housing. The pivot mounting 22 swivels about a pivot position 23 that is offset from the back end of socket housing 13. (See FIGS. 5 and 5A, in which pivot position 23 is visible.) The pivot position may be conveniently located adjacent to the forward portion of socket 14 such as seen in FIG. 3A. An important characteristic of the present construction may be described with reference to moment arm 24, which is defined as the distance from pivot position 23 to the front extremity of lamp holder 17 with bulb 16 installed along a straight line perpendicular to the pivot axis through pivot position 23. With a sidewall pivot mounting such as illustrated here, lamp holder 11 pivots about the pivot point 23 with a moment arm 24 that is significantly shorter than the overall length of the lamp holder itself. Thus, the volume of space swept out by the lamp holder as it is aimed in various directions is significantly less than is swept out in fixtures of the prior art with end-type lamp holder mountings. That is to say, the lamp holders in the present invention are confined to a smaller volume and thus provide less opportunity for interference with the field of view of the motion detector. In the space about base 10 there is more room for permissible movement of detector housing 12.

Pivot mounting 22 is preferably provided with a releasable locking mechanism, by which the user may release the pivot mounting for pivoting the lamp holder to the desired direction and then lock the mounting for securing the aimed lamp holder in place. In the embodiment illustrated here the releasable locking mechanism is provided by a pair of rings 27A and 27B with interlocking sawtooth-shaped surfaces. One ring is fixed to socket housing 13 and the other to support arm 21. The rings are held in their interlocking configuration by tightening a bolt attached to knob 28. The particular form of releasable locking mechanism is not important for the present invention, and other mechanisms based on friction, detents, tabs or the like may readily be used in place of that illustrated here.

Figure 4:
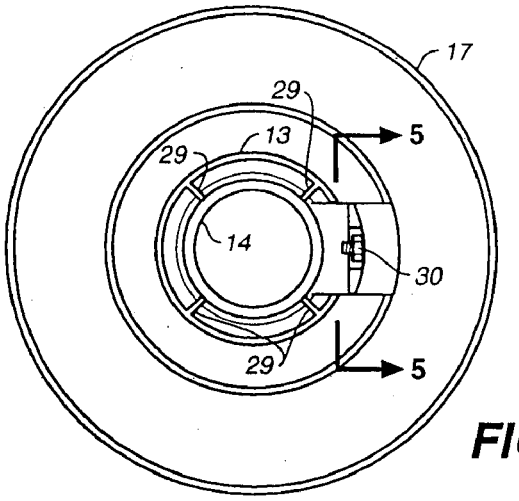
FIG. 4 is a front elevational view of a lamp holder assembly.
Figure 6:
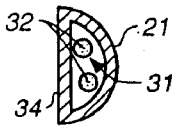
FIG. 6 is a cross-sectional view of the support arm along the line 6—6 of FIG. 3A.

FIG. 4 shows the interior of a lamp holder 11. Socket 14 is positioned in the center of socket housing 13 by longitudinally extending positioning vanes 29. A nut 30 forming a part of pivot mounting 22 is also seen in FIG. 4.

Figure 5:
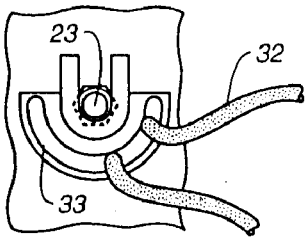
FIG. 5 is a detail view along the line 5—5 of FIG. 4.
Figure 5A:
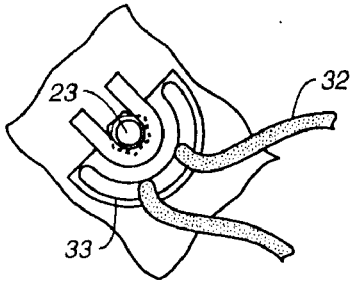
FIG. 5A is a view of the detail of FIG. 5 with the lamp holder rotated to a different position.

To provide electrical connection to socket 14 and bulb 16, support arm 21 defines an interior passageway 31 through which electrical wires 32 lead to the socket. To reduce binding of the wires as socket housing 13 pivots about the pivot point, the socket housing has an arcuate slot 33 formed in it about pivot position 23 and in communication with passageway 31. As the lamp holder is rotated, the wires slide along slot 33 without binding. FIGS. 5 and 5A show two different positions of the lamp holder with the wires appearing in two different positions in the slot.

FIGS. 2 and 2A show two typical orientations of the lamp holders and motion detector housing. In FIG. 2 the fixture is oriented to cover a close-in region. Motion detector housing 12 is angled downward to monitor a region comparatively close to the fixture and lamp holder 11 is also turned down to illuminate the close-in area when triggered by the motion detector. It is to be noted that ample space is provided for aiming the lamp holder and the motion detector without any interference between them, notwithstanding the compactness of the overall fixture. In FIG. 2A the lamp holder and motion detector housing are oriented to cover an area more distant from the fixture without impairing the comparatively sleek profile of the fixture. The plan view of FIG. 3 clearly displays the overall compactness of the fixture achievable with the present invention.

To provide for an even more compact configuration, support arm 21 may be formed with a flat side 34 facing its respective socket housing 13 so that the socket housing may be brought in closer to the support arm without any interference.

The above descriptions and drawings disclose illustrative embodiments of the invention. Given the benefit of this disclosure, those skilled in the art will appreciate that various modifications, alternate constructions, and equivalents may also be employed to achieve the advantages of the invention. Therefore, the invention is not to be limited to the above description and illustrations, but is defined by the appended claims.

What is claimed is:

1. A light fixture activated by a passive infrared motion detector including a base, at least one lamp holder attached to said base for holding a lamp bulb, and a detector housing attached to said base for housing said motion detector, wherein said lamp holder comprises a socket housing, a socket included in said socket housing for receiving said lamp bulb, and a support arm movably connecting said socket housing to said base so as to permit a user to aim said lamp holder in a desired direction, and wherein said motion detector has a field of view and said detector housing is movably mounted to said base so as to permit a user to aim said field of view in a desired direction, said light fixture being characterized in that said support arm is pivotably connected to said socket housing at a side wall of said socket housing at a pivot position adjacent said socket whereby said lamp holder pivots about said position with a moment arm shorter than the overall length of said lamp holder, wherein said moment arm is sized and said detector housing is disposed to permit sufficient freedom of movement for said lamp holder and said detector housing to be aimed in desired directions without interfering with one another.

2. The apparatus of claim 1, further comprising a releasable locking means connecting said support arm to said socket housing that is releasable for aiming said lamp holder and lockable for securing an aimed lamp holder in place.

3. The apparatus of claim 1 wherein said support arm is formed with a flat side facing said socket housing, whereby said socket housing may be spaced closer to said support arm without interference.

4. The apparatus of claim 1, wherein said support arm defines an interior passageway for conveying electrical wires to said socket and said socket housing defines an arcuate slot formed about said pivot position and communicating with said passageway to reduce binding of said wires as said socket housing pivots about said pivot point.

5. The apparatus of claim 4, further comprising a releasable locking means connecting said support arm to said socket housing that is releasable for aiming said lamp holder and lockable for securing an aimed lamp holder in place.

* * * * *

UNITED STATES PATENT AND TRADEMARK OFFICE

CERTIFICATE OF CORRECTION

PATENT NO. : 5,649,761
DATED : July 22, 1997
INVENTOR(S) : Sandell et al.

It is certified that error appears in the above-identified patent and that said Letters Patent is hereby corrected as shown below:

Drawings,
Please insert attached page 4 of 4, Figures 3A - 6.

Signed and Sealed this

Sixth Day of July, 2004

JON W. DUDAS
*Acting Director of the United States Patent and Trademark Office*